US005134554A

United States Patent [19]

Donato et al.

[11] Patent Number: 5,134,554

[45] Date of Patent: Jul. 28, 1992

[54] LIGHTING SYSTEM

[75] Inventors: Anthony C. Donato, Westfield, N.J.; Alejandro Mier-Langner, Brooklyn, N.Y.; Albert L. Newman, West Orange, N.J.

[73] Assignee: Lightolier, Inc., Secaucus, N.J.

[21] Appl. No.: 575,291

[22] Filed: Aug. 30, 1990

[51] Int. Cl.[5] ..... F21V 21/02; F21V 29/00

[52] U.S. Cl. ..... 362/226; 362/294; 362/373; 362/407; 362/408; 439/218; 439/220

[58] Field of Search ..... 362/226, 294, 363, 373, 362/404, 407, 408; 439/217, 218, 220, 668, 669

[56] References Cited

U.S. PATENT DOCUMENTS

| | | | |
|---|---|---|---|
| 1,700,538 | 1/1929 | Grant et al. . | |
| 2,131,054 | 9/1938 | Kurth . | |
| 3,047,829 | 7/1962 | Mouat . | |
| 3,626,424 | 3/1970 | Kahn | 362/294 |
| 3,684,883 | 8/1972 | Entwistle . | |
| 3,878,505 | 4/1975 | Seibert . | |
| 3,894,205 | 7/1975 | List et al. . | |
| 3,985,417 | 10/1976 | Fenton . | |
| 4,003,618 | 1/1977 | Booty . | |
| 4,029,953 | 6/1977 | Natoli . | |
| 4,104,713 | 8/1978 | Chan et al. . | |
| 4,126,810 | 11/1978 | Cox . | |
| 4,280,170 | 7/1981 | Baldwin . | |
| 4,363,086 | 12/1982 | Fletcher . | |
| 4,426,677 | 1/1984 | Dennis . | |
| 4,428,032 | 1/1984 | Workman | 362/29g33 5 |
| 4,504,888 | 3/1985 | Rosenthal | 362/373 |
| 4,531,179 | 7/1985 | Baker | 362/294 |
| 4,595,971 | 6/1986 | Dean . | |
| 4,670,822 | 6/1987 | Baker . | |
| 4,702,711 | 10/1987 | Falchi . | |
| 4,758,181 | 7/1988 | Reedy . | |
| 4,763,231 | 8/1988 | Houplain . | |
| 4,816,977 | 3/1989 | Sorensen . | |
| 4,858,089 | 8/1989 | Pietro | 362/373 |

FOREIGN PATENT DOCUMENTS

| | | | |
|---|---|---|---|
| 1117748 | 11/1961 | Fed. Rep. of Germany | 439/220 |
| 800059 | 8/1958 | United Kingdom | 439/220 |

*Primary Examiner*—Richard R. Cole

*Attorney, Agent, or Firm*—Hopgood, Calimafde, Kalil, Blaustein & Judlowe

[57] ABSTRACT

A lighting system comprising a power jack, a first or second type plug connector and luminaire assembly. The power jack is adapted to receive either a first or second type plug connector. The luminaire assembly includes a lamp socket subassembly, and a globe subassembly. The lamp socket subassembly comprises a lamp socket which is supported by a lamp socket support housing which bears a plurality of lamp socket support projections. The globe subassembly includes a globe, a globe support housing with engaging projections and a globe retaining element. The lamp socket support housing is adapted to be received within a portion of the globe support housing and interconnected by engagement of the lamp socket support projections with the engaging projections. In the engaged configuration, air-flow channels are formed between the housing. Air-flow passages are also formed between the globe and the globe support housing when interconnected by retaining element. The air-flow channels and passageways are in communication with each other and the ambient atmosphere to create air flow patterns which effect cooling of the lamp unit in the lamp socket.

27 Claims, 5 Drawing Sheets

LIGHTING SYSTEM

BACKGROUND OF THE INVENTION

1. Field of Invention

The present invention relates generally to a lighting system that has modular components which simply plug and/or releasably lock-together, and more particularly, to an improved power jack, a plug connector for use therewith, and a luminaire assembly suitable for use with a tungsten-halogen or like lamp unit.

2. Brief Description of the Prior Art

There are a variety of lighting systems known in the art for providing accent and/or display lighting. In general, each of these lighting systems include a power jack of one sort installed in a ceiling or wall structure, and a lamp unit installed in a socket which is suspended from the power jack. In many prior art lighting systems, electrical power is provided to the lamp unit from the power jack by way of electrical cord, and the lamp unit is supported by the electrical cord or some other means.

One popular lamp unit used in accent and display lighting is the tungsten-halogen lamp. While the tungsten-halogen lamp has many desirable properties and characteristics, such as high luminous output, prior art lighting systems, in general, have not ensured that such lamp units will necessarily be utilized under conditions which ensure extended lamp life, and safe and versatile operation by the end user.

Accordingly, it is a primary object of the present invention to provide a luminaire assembly for a halogen lamp unit, which has a modular construction that permits replacement and interchangability of its component parts.

It is another object of the present invention to provide such a luminaire assembly that completely encloses and protects the lamp unit from breakage and produces an air flow pattern about the lamp unit that permits operation at lower temperatures to ensure extended lamp life.

Another object of the present invention is to provide a luminaire assembly which permits installation of a shade only in conjunction with a protective globe.

Another object of the present invention is to provide a luminaire assembly having a globe which completely encloses the lamp unit and which will contain fragments of the lamp unit upon lamp unit breakage.

Another object of the present invention to provide such a luminaire assembly having a globe subassembly and a lamp socket subassembly that can be connected together and separated by a simple lift and turn operation.

It is a further object of the present invention to provide a power jack that is capable of receiving either a first or a second type plug connector, each of which is adapted to transfer electrical power to a lamp unit, while physically supporting the same.

Another object of the present invention is to provide such a power jack, in which the first type plug connector has threads which are adapted to be securely received in the power jack socket so that substantial lamp loads may be supported from the power jack.

Another object of the present invention is to provide such a power jack, in which the second type plug connector has a circumferential groove on its stem which is releasably received upon snap-fitting the plug connector into the power jack, through a jack socket adaptor.

Another object of the present invention is to provide either a first or a second type plug connector which has a cord splicing compartment that completely contains spliced wires and knotted electrical cords in an aesthetically pleasing manner, while providing an extended plug structure that provides additional mechanical advantage when inserting either type plug connector into the power jack socket.

A further object of the present invention is to provide such plug connectors with a cord splicing compartment that permits simple adjustment of the length of both electrical cord and support cable in the field.

An even further object of the present invention is to provide a matched power jack and plug connector which (i) can support heavy lamp loads, (ii) requires no keying between the plug connector and jack socket, and (iii) ensures precise electrical mating between the electrically conductive elements on the plug stem and in the jack socket.

Yet a further object of the present invention is to provide a halogen lighting system having all of the above-described features.

These and other objects of the present invention will become apparent hereinafter.

SUMMARY OF INVENTION

According to one aspect of the present invention, a luminaire assembly is provided. In general, the luminaire assembly comprises a lamp socket subassembly, and a globe subassembly.

The lamp socket is mounted to a lamp-socket support means and is adapted for suspension from a support structure, such as a support wire or cable. The globe subassembly includes a globe and globe support means. The globe support means has a central passageway which permits positioning of the lamp socket support means therein. The globe subassembly further includes globe retaining means which permits releasable retention of the globe at a distance from the globe support means, so as to provide one or more air-flow passageways between the globe support means and the globe. The luminaire assembly is also provided with means for releasably securing the lamp socket support means to the globe support means while the lamp socket support means is positioned within the globe support means. In such a secured configuration, one or more air-flow channels are provided between the globe support means and the lamp socket support means.

In the preferred embodiment, the air-flow passageways are in communication with the air-flow channels, and the air-flow passageways and the air-flow channels are in communication with ambient atmosphere in order to transfer heat away from the lamp unit. Also, the luminaire assembly includes a shade support flange on the globe subassembly for supporting one of a variety of shades. The globe completely encloses the lamp unit so as to prevent breakage thereof during use.

Another aspect of the present invention is a power jack that permits insertion of one of two principally different plug connectors. The first type plug connector comprises a stem portion adjoined to a cylindrical base portion bearing external threads. These threads are adapted for engagement with matching threads disposed on the inside of the jack socket, while electrically conductive plug elements on the distal end of the stem portion engage corresponding conductive socket elements disposed within the socket itself. Lead wires are internally connected to these jack elements within a bore that extends longitudinally along the length of the first type plug connector.

The second type plug connector comprises a stem portion also bearing first and second electrically conductive plug elements, as in the first type plug connector. However, the second type plug connector also bears a circumferential groove about the stem portion which is adapted for engagement with a biased retaining element disposed within the jack socket. Preferably, when using the second type plug connector, a socket adapter is inserted into the jack socket to adapt the diameter of the socket to approximately that of the stem portion of the second type plug connector, which is proximate the socket opening.

Another aspect of the present invention concerns a plug connector for insertion into a power jack. In general, the plug connector of the present invention comprises a cylindrical base portion, an electrically non-conductive stem portion, and first and second electrically conductive plug elements. Cylindrical base portion bears threads which are adapted to be received by matching threads disposed within the socket of a power jack. Electrically non-conductive stem portion is adjoined to the cylindrical base portion and has an axially disposed bore which extends through the stem and cylindrical base portions. The first and second conductive plug elements are disposed at the distal end of the stem portion, at a predetermined distance apart, with lead wires attached to the conductive plug elements and extending through and beyond the axially disposed bore.

In the preferred embodiment, the plug connector of the present invention, whether of the first or second type, is provided with a cord splicing compartment that is operably associated with the proximal portion of either plug connector. In the case of the first type plug connector, the cord splicing compartment is attached to the cylindrical base portion and permits complete enclosure of spliced wires within the housing of cord splicing compartment. At its opposite end, a support cable is permitted to pass through the housing, be adjusted in length, and thereafter secured. Electrical cord spliced to the lead wires of the plug connector, is permitted to pass through a port formed in the housing. In the case of the second type plug connector, the cord splicing compartment is simply adjoined to the proximal portion of the stem of the plug connector in a way that permits passage of plug lead wires to respective terminals of the electrical cord extending to the lamp unit.

Yet another aspect of the present invention is to provide a lighting system for accent and display lighting, that embraces a combination of the inventive features of the present invention. In general, the lighting system of the present invention comprises the power jack, a first or second type plug connector, the luminaire assembly, and a luminaire assembly support means which can be, for example, a support cable or an elongated stem structure extending between the plug connector and the luminaire assembly.

In the preferred embodiment, the lamp unit of the luminaire assembly is a halogen-tungsten lamp. However, the illumination system of the present invention can be adapted for use with other types of lamp units, with excellent results.

DETAILED DESCRIPTION OF THE DRAWINGS

In order to more fully illustrate the objects of the present invention, the Detailed Description of the Illustrative Embodiments is to be taken in connection with the drawings, in which:

FIG. 14 is an elevated cross-sectional side view of the assembled globe subassembly and an elevated side view of a portion of the lamp socket subassembly, illustrating the securing means associated with these two subassemblies; and .

DETAILED DESCRIPTION OF ILLUSTRATIVE EMBODIMENTS

Figure 1:
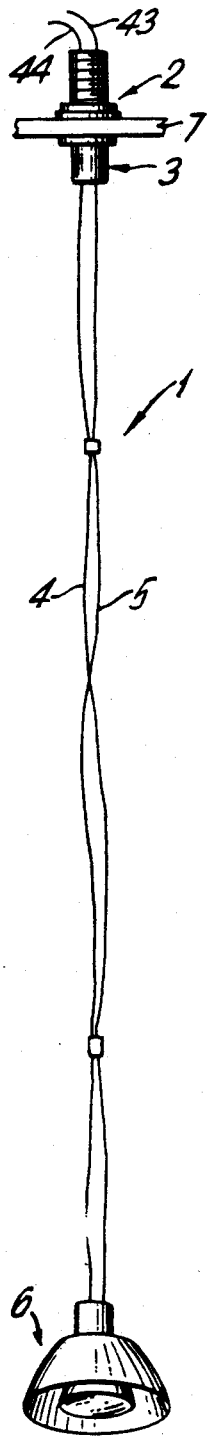
FIG. 1 is a perspective view of a lighting system of the present invention, shown with its components connected together.

While various aspects of the present invention are illustrated in a low-voltage tungsten-hologen "drop type" lighting system and its modular components shown in the drawings, it is understood that the features of the present invention may also be realized in other types of low or line voltage lighting systems.

In FIG. 1, drop-type lighting system 1 of the present invention is shown generally comprising a power jack 2, a plug connector 3, support cable 4, twin lead electrical cord 5, and luminaire assembly 6. Power jack 2, more clearly illustrated in FIGS. 2 and 5 through 12, is a recessed-type unit shown mounted through a horizontally disposed ceiling support structure 7. However, in other embodiments and applications, it is understood that the power jack of the present invention may be mounted through other types of support structures, or be realized as a surface-mount or track-type power jack.

As illustrated in FIG. 1, luminaire assembly 6 is physically connected to plug connector 3 by support cable 4, and is electrically connected to plug connector 3 through electrical cord 5. Plug connector 3, in turn, is releasably inserted into power jack 2, and thereby supports luminaire assembly 6 below support structure 7 at a height determined essentially by the length of support cable 4. Alternatively, it is understood that in accordance with the present invention, luminaire assembly 6 may be supported by an elongated stem structure that is connected to a plug connector of the type shown in either FIGS. 2 or 3. An example of an elongated stem structure which can be readily adapted for such use, is disclosed in pending U.S. patent application entitled Modular Stem System For Lighting Applications, by applicants, filed on Aug. 30, 1990, which is incorporated herein by reference. Thus the height of luminaire assembly 6 of such an alternative embodiment, will be determined by the length of the elongated stem structure.

Figure 2:
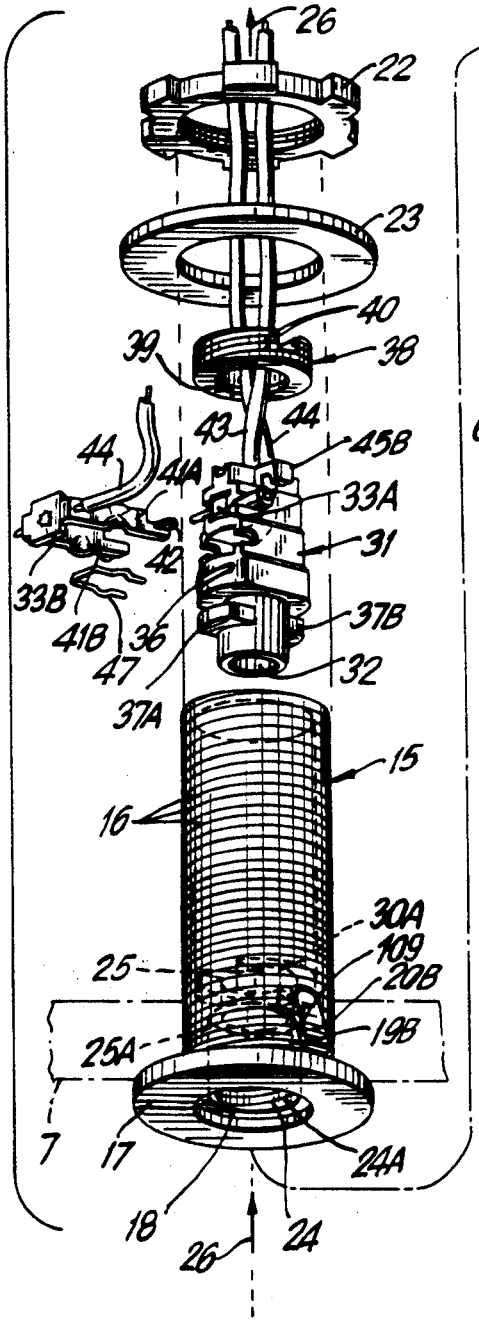
FIG. 2 is an exploded view of the components of the power jack and plug connector of the present invention.
Figure 2:
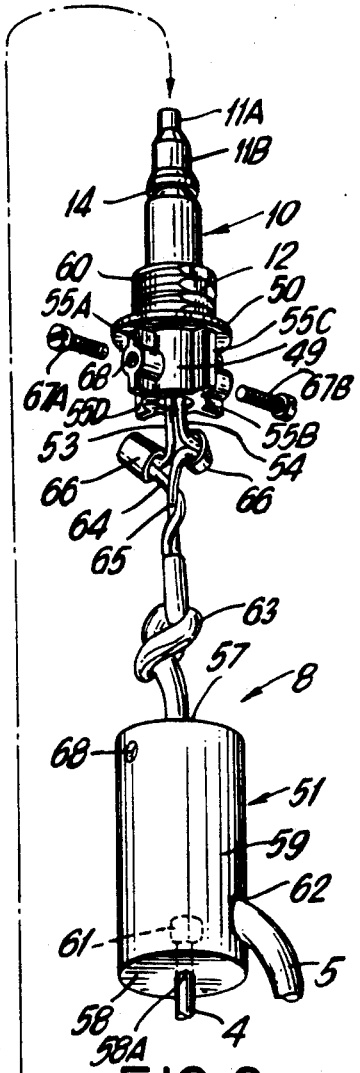
Figure 3:
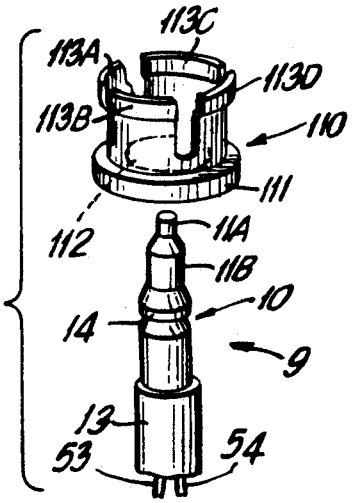
FIG. 3 is a perspective view of the jack socket adapter of the present invention, and a conventional plug connector of a drop-light stem designed for use with the power jack and jack socket adapter of the present invention.
Figure 5:
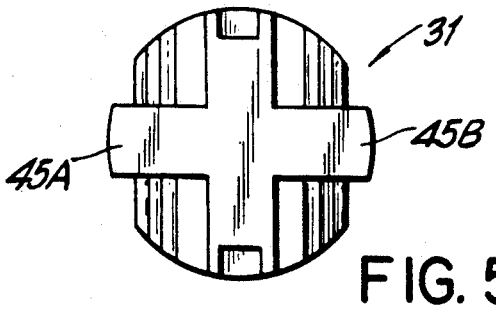
FIG. 5 is a top plan view of the jack module shown in FIG. 1.

A significant feature of power jack 2 of the present invention is that it is particularly adapted to receive two principally different types of plug connectors 8 and 9, illustrated in FIG. 2 and FIG. 3, respectively.

A first type plug connecter 8 illustrated in FIG. 2 comprises an electrically non-conductive stem portion 10 with first and second electrically conductive plug elements 11A and 11B disposed at the distal end thereof, and a cylindrical base portion 12 adjoined at the proximal end of stem portion 10. The external surface of cylindrical base portion 12 is provided with external threads 60.

As illustrated in FIG. 3, second type plug 9 may, for example, terminate the stem portion 13 of an elongated stem structure of the type described hereinabove. Second type plug connector 9 has a stem portion 10 and first and second electrically conductive plug elements 11A and 11B. Plug connector 9 is also provided with circumferential groove 14 below the first and second conductive plug elements.

To fully appreciate the versatile nature of the power jack of the present invention, it is appropriate at this juncture to describe its structure and function below.

Figure 10:
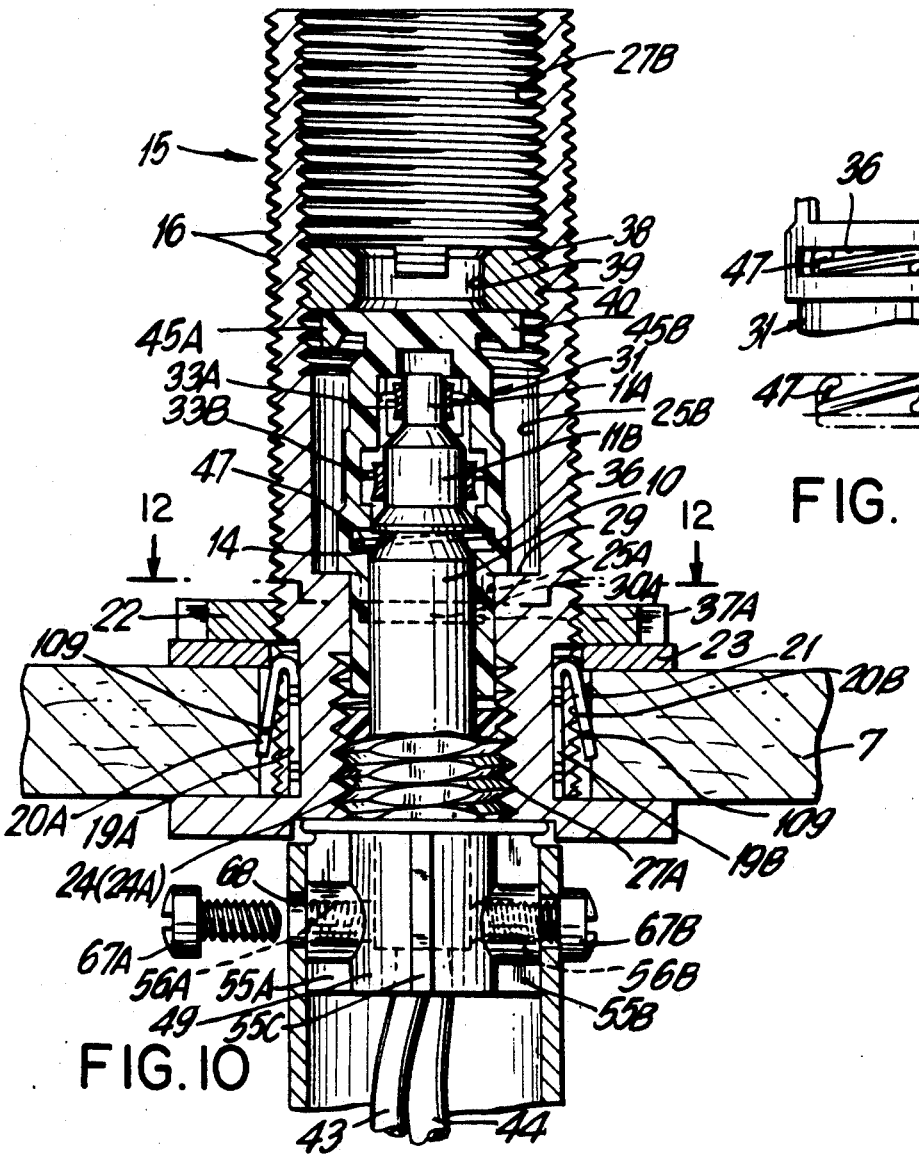
FIG. 10 is a cross-sectional view of the plug connector and jack of FIG. 2 assembled and interconnected as in FIG. 1.

As illustrated in FIG. 2, power jack 2 comprises a cylindrical housing 15 bearing external threads 16 and an annular-shaped housing flange 17 disposed adjacent a socket opening 18. Cylindrical housing 15 has a pair of diametrically disposed rectangular recesses 19A and 19B adjacent housing flange 17. As illustrated in FIGS. 2 and 10, spring tab projections 20A, 20B are press fit into respective rectangular recess 19A, 19B so as to project outward and downwardly away from cylindrical housing 15, at an acute angle. In order to facilitate retention of spring tabs in respective recesses, each side of each spring tab is provided with fine pin-like projections 109 that grip into the side walls of the respective rectangular recess. As illustrated in FIG. 10, these spring tab projections 20A, 20B retain cylindrical housing 15 within aperture 21 formed in ceiling structure 7 while threaded lock nut 22 and washer 23 are being threaded over external threads 16 of cylindrical housing 15. Advantageously, a tradesman installing power jack 2 is not required to hold it in place while preparing to install washer 23 and lock nut 22 over the threads of cylindrical housing 15.

Figure 12:
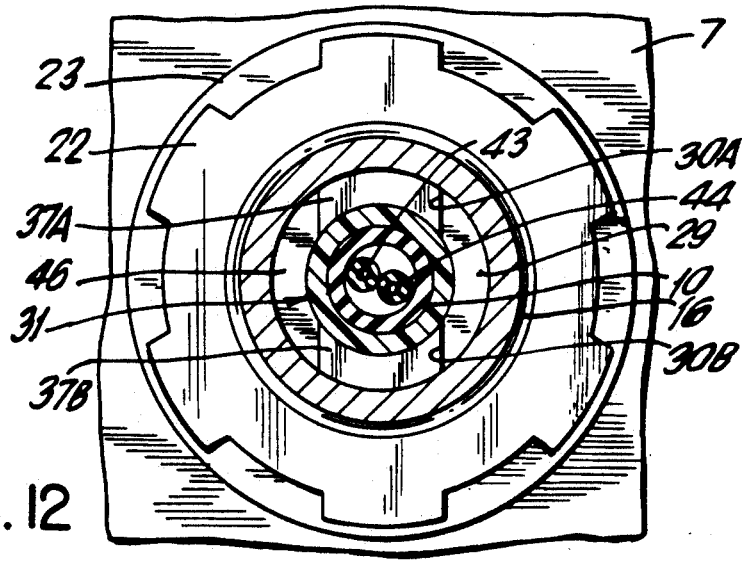
FIG. 12 is a cross-sectional view taken along line 12—12 of FIG. 10, showing the plug connector and power jack of the present invention interconnected with each other.

Cylindrical housing 15 includes socket 18 having opening 24 and a bore 25 extending from opening 24 along longitudinal axis 26. Bore 25 has a first cylindrical portion 25A adjacent opening 24 and bears threads 24A which are adapted to be received by matching threads 12 disposed on first type plug 8, i.e., when stem portion 10 is screwed into socket 18. Bore 25 also has a second cylindrical portion 25B which is disposed beyond first cylindrical portion 25A and has inner threads 27B along the upper portion of its length, as shown in FIG. 10. In the illustrated embodiment, the diameter of second cylindrical portion 25B is greater than first cylindrical portion 25A; consequently, at the interface thereof, annular ledge 29 is formed. As shown in FIG. 12, annular ledge 29 includes a pair of guides slots or recesses 30A and 30B, whose function will be described hereinafter.

As illustrated in FIGS. 2 and 5 through 10, second cylindrical bore portion 25B contains jack module 31 which has longitudinally extending module bore 32. In general, first and second conductive jack elements 33A and 33B are disposed along module bore 32 so that when first or second type plug connector 8, 9 is selectively inserted into socket 18, (i) the stem portion of either type plug connector passes through at least a portion of module bore 32, and (ii) first conductive plug element 11A of either type plug connector engages first conductive jack element 33A and second conductive plug element 11B engages second conductive jack element 33B.

Figure 4:
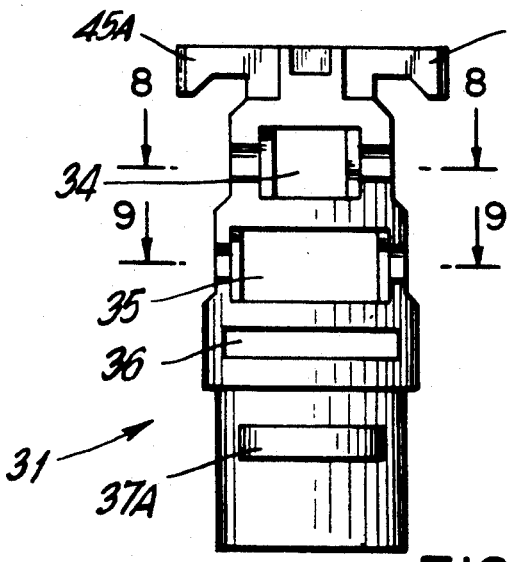
FIG. 4 is a first side elevational view of the jack module used in the power jack shown in FIG. 1.
Figure 7:
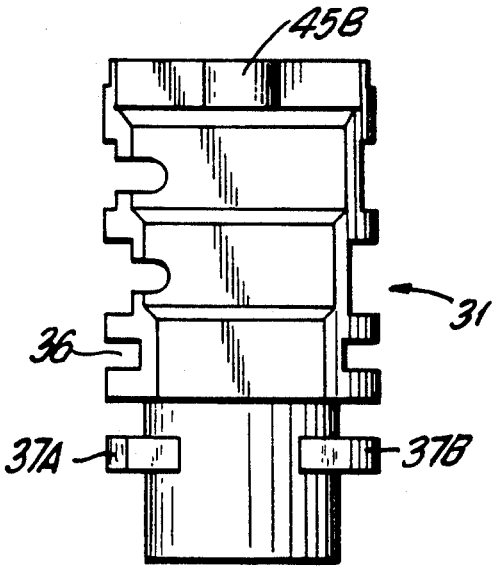
FIG. 7 is a second side view of the jack module of the power jack of FIG. 1.
Figure 6:
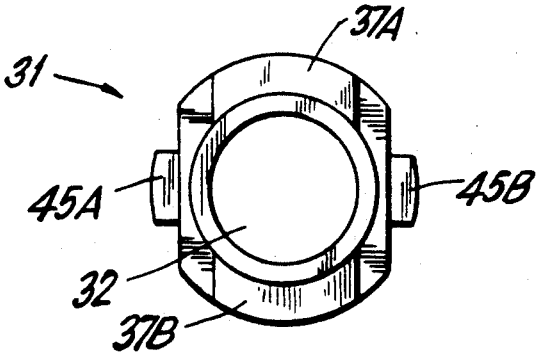
FIG. 6 is a bottom plan view of the jack module shown in FIG. 1.
Figure 8:
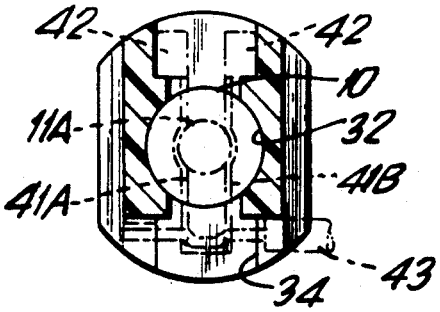
FIG. 8 is a cross-sectional view taken along line 8—8 of FIG. 4, showing the jack module with the first electrically conductive jack element installed within the first transverse slot of the jack module.
Figure 9:
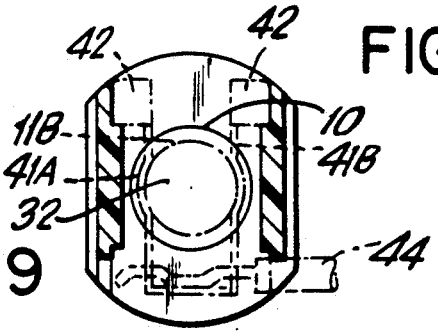
FIG. 9 is a cross-sectional view taken along line 9—9 of FIG. 9, showing the jack module with the second electrically conductive jack element installed within the second transverse slot of the jack module.

As shown in FIG. 4, module 31 is provided with first and second transverse slots 34 and 35 which pass through module bore 32, and are adapted to receive first and second conductive jack elements 33A and 33B, respectively. Module 31 also includes a third transverse slot 36 which passes through module bore 32, and beyond first and second transverse slots 34 and 35. Below third transverse slot 36, a pair of diametrically disposed guide flanges 37A and 37B extend orthogonally with respect to module bore 32. As illustrated in FIG. 12, guide flanges 37A and 37B fit within respective guide recesses 30A and 30B formed in annular ledge 29. The function of guide flanges 37A, 37B and guide recesses 30A, 30B is to prevent module 31 from rotating when matching threads 60 on first type plug 8 are screwed over threads 27A of first cylindrical bore portion 25A. To install module 31 in socket jack 2, module 31 is slid into bore portion 25B, and then retaining ring 38 with hollow center 39 and threads 40 is screwed into bore portion 25B and tightened down upon alignment flanges 45A and 45B, as shown in FIG. 10.

As illustrated in FIGS. 2, 8, 9 and 10, first and second electrically conductive jack elements 33A and 33B each comprise a pair of resilient conductive arms 41A and 41B which are adapted to snap into first and second transverse slots 34 and 35. Each resilient conductive arm 41A, 41B of each conductive jack element comprises a substantially planar portion extending through module bore 32, and bears a retaining tab 42 at the end thereof. These tabs 42 are adapted to retain conductive arms in respective transverse slots. First and second lead wires 43 and 44 are connected to first and second conductive jack elements 33A and 33B, respectively. With elements 33A and 33B snapped into respective slots 3 and 35 and retaining ring 38 screwed down upon alignment flanges 45A and 45B, lead wires 43 and 44 are permitted to extend along narrow channel 46 provided along second cylindrical bore portion 25B. Lead wires 43 and 44 extend beyond channel 46 to a transformer (not shown) employed in low-voltage (e.g., 6–12 volt) applications. Alternatively, lead wires 43 and 44 may extend beyond channel 46 to a line-voltage (e.g., 110–220 volt) supply employed in line-voltage applications.

Figure 11:
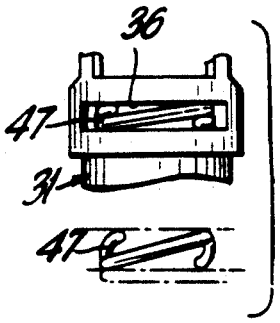
FIG. 11 is a side view of the jack module of FIG. 2, showing the plug retaining element installed within the third transverse slot of the jack module.

In order to realize a stem retaining means along the longitudinal axis of bore 32, spring retaining element 47 is compressed and then slipped into third transverse slot 36, as illustrated in FIG. 11. This stem retaining means 47 extends partially into module bore 32 and is adapted to engage with circumferential groove 14 in stem portion 90, thereby releasably retaining a second type plug 9, as shown in FIG. 3.

Having described the power jack of the present invention, it is now in order to describe the structure and function of the plug connector of the present invention below.

In FIG. 2, first type plug connector 8 is shown generally comprising cylindrical base portion 12, stem portion 10 adjoined thereto at its proximal end, a bore portion 49 extending beyond plug flange 50, and a cord splicing compartment 51. Bore 52 extends along the longitudinal axis of plug connector 8, and provides a passageway for a pair of conductive lead wires 53 and 54 to connect with first and second conductive plug elements 11A and 11B, respectively. A set of wing-like flanges 55A, 55B and 55C, 55D are diametrically disposed about bore portion 49. As shown in FIG. 10, wing-like flanges 55A and 55B are provided with threaded holes 56A, 56B for attachment of cord splicing compartment 51, in a manner to be described hereinafter.

In FIGS. 2, 3 and 10, first conductive plug element 11A is realized as a cylindrical electrode disposed at the tip of second type plug connectors 8 and 9, whereas second conductive plug element 11B is realized as an annular electrode disposed at a predetermined distance from first conductive plug element 11A. Disposed slightly below second conductive plug element 11B on stem portion 10, above threads 12, circumferential groove 14 is formed as described hereinbefore. Circumferential groove 14, together with retaining element 47, functions as the plug retaining means of a second type plug connector constructed in accordance with the preferred embodiment of the present invention.

As illustrated in FIG. 2, cord splicing compartment 51 has an open end 57 and a closed end 58, and a cylindrical side wall 59 which extends between open and closed ends 57 and 58. At closed end 58, a hole 60 is centrally formed and permits passage of support cable 5. To prevent support cable 4 from being pulled out of hole 60, a malleable terminal element 61 is crimped onto the end of support cable 5 once its desired length has been determined. Terminal element 61, in effect, functions as a means for securing one end of support cable to cord splicing compartment 51, while providing versatility in adjusting the support cable length. In the lower end portion of side wall 59 of cord splicing compartment 51, a port 62 is formed for permitting passage of electrical cord 5 through the compartment housing and down along support cable 4, to luminaire assembly 6, as shown in FIG. 1. Once the length of electrical cord 5 has been determined, a knot 63 is tied therein and respective cord conductors 64, 65 are spliced together with conductive plug leads 53, 54, using for example, splicing caps 66, as shown in FIG. 2. The spliced wires are then inserted into the hallow cavity of cord slicing compartment 51, and the open end is fitted over wing-like side flanges 55A through 55D, as shown in FIG. 10. Then, screws 67A, 67B are passed through bores 68 in cord splicing compartment 59 and threaded into flanges bores 56A, 56B respectively, to secure cord splicing compartment 59 to first type plug connector 9.

With power jack 2 of the present invention, first type plug connector 8 can be screwed into the socket of power jack 2 as shown in FIG. 10. Advantageously, having screw threads 60, first type plug 9 is capable of typically supporting luminaire assemblies weighing as much as 25 pounds or more. Alternatively, second type plug connector 9 can be snap-fit inserted into socket 18 of power jack 2 and held securely in place by a plug retaining element 47 which engages a selected portion of circumferential groove 14 of plug stem 10, as shown in FIG. 10. Notably, plug connector 8 of FIG. 10 has been provided with both threads 60 and circumferential groove 14 only for the purpose of illustrating that power jack 2 of the present invention is particularly adapted to receive both first and second type plug connector 8 and 9, respectively. Thus, circumferential groove 14 is neither required nor desired in first type plug connectors 8.

Preferably, when a second type plug 9 is to be received by power jack 2, socket adapter 110 shown in FIG. 3 is first inserted into jack socket 18, so as to adapt the socket bore 25 to the cross-sectional diameter dimension of the stem 13 of second type plug 9. As illustrated socket adapter 110 has an annular flange 111 with adapter bore 112 formed in its central region. Preferably the diameter of adapter bore 112 is a fraction larger than the diameter of stem 13, which will be proximate adapter flange 111 when second type plug connector 9 is snap-fitted into jack socket 18. To retain socket adapter 110 within the bore portion 25A, a plurality of fingers 113A, 113B, 113C and 113D are formed orthogonally from annular flange 111. When socket adapter 110 is press fitted into socket 18, annular flange 111 will reside within circular opening 18 and provide a uniform appearance. At the same time, stem 13 associated with second type plug connector 9, is permitted to pass through adapter bore 112 and is essentially stabilized.

Figure 13:
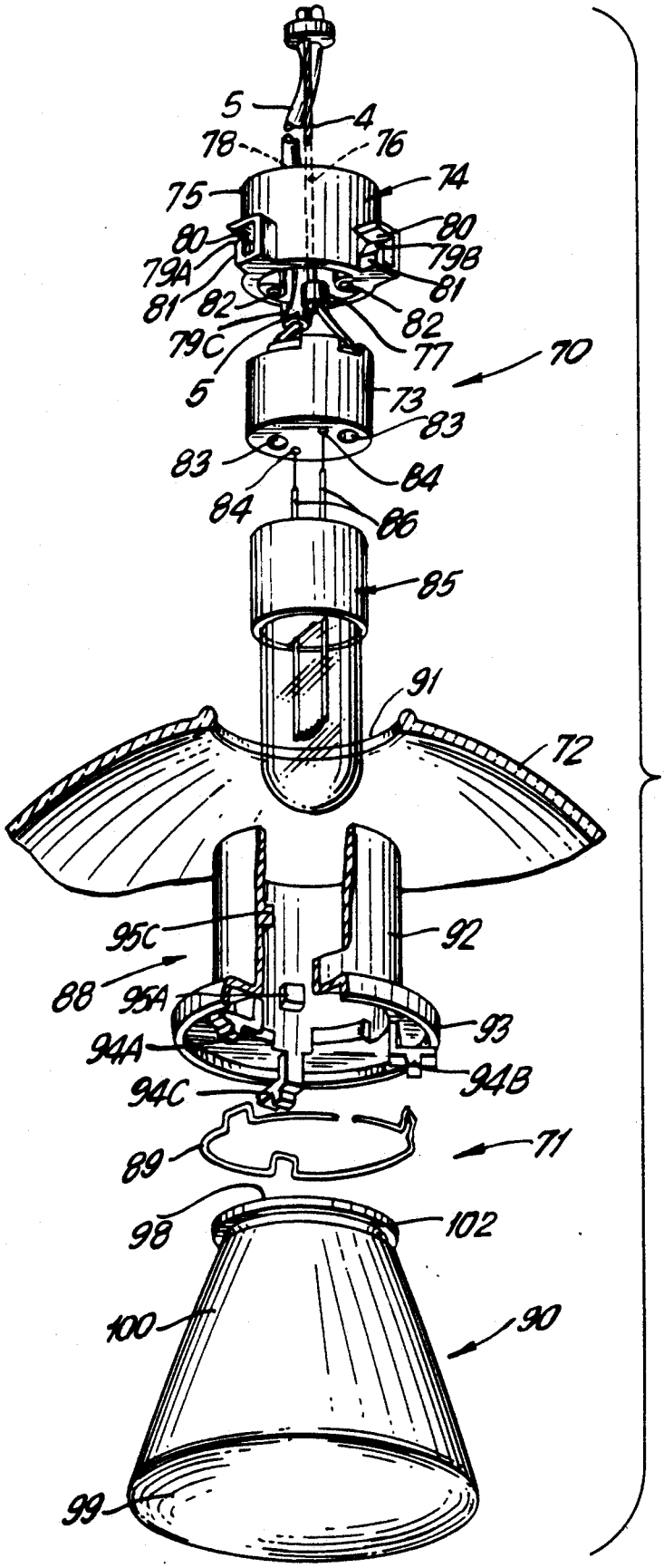
FIG. 13 is an exploded view of the luminaire assembly of the present invention, showing the components of the lamp socket subassembly and the globe subassembly of the present invention.
Figure 14:
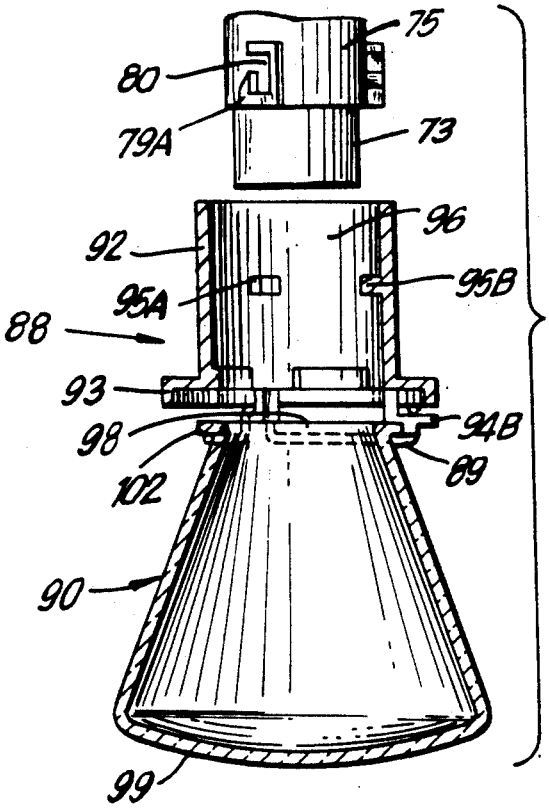
Figure 15:
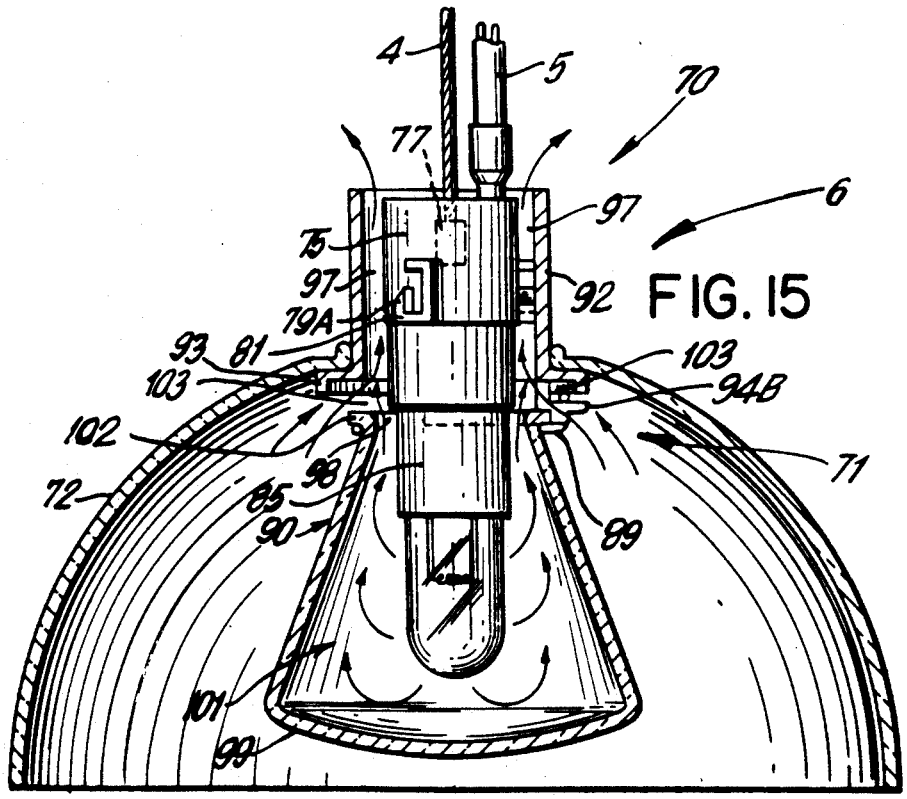
FIG. 15 is an elevated cross-sectional side view of the lamp socket and globe subassemblies completely assembled and interconnected, illustrating the air flow pattern created by the subassemblies during operation of the lamp unit.

Referring to FIGS. 13 through 15, the luminaire assembly of the present invention will now be described.

In FIG. 13, the components of lamp socket subassembly 70 and globe subassembly 71 are shown, along with a cross-sectional portion of a shade 72. Lamp socket subassembly 70 includes a cylindrically shaped lamp socket 73 mounted on a lamp socket support means 74. Lamp socket support means comprises a cylindrical body portion 75 having a centrally disposed aperture 76 through which support cable is permitted to pass, and behind which support cable is secured by a terminal element 77 clamped at its end. Cylindrical body portion 75 is also provided with an eccentrically disposed port 78 permitting passage of electrical cord 5 to lamp socket 73. As illustrated, a triad of symmetrically spaced apart lamp socket support projections 79A, 79B and 79C extend from the side walls of cylindrical body portion 75. In the illustrated embodiment, each lamp socket support projection comprises a three-sided projection enclosing a slot 80 which is partially occluded by a fourth side wall projection 81. The bottom portion of cylindrical body portion 75 is provided with a pair of bores 82, for passing screws through coinciding bores 83 formed in lamp socket 73, to secure it to cylindrical body portion 75. Lamp socket 73 is provided with a pair of spaced-apart pinhole sockets 84, which in turn are electrically connected to the leads of electrical cord 5 in a manner known in the art. The conductor pins 85 of a conventional halogen-tungsten lamp unit 85 are simply pushed into these pin-sockets 84, to connect and secure lamp unit 85 to lamp socket 73.

As illustrated in FIG. 13, globe support subassembly 74 comprises shade 72, globe support means 88, an open-ended spring clip 89, and a globe 90. Shade 72 can be of virtually any geometry and only requires an aperture 91 for seating upon globe support means 88. In the illustrated embodiment, globe support means 88 comprises a hollow cylindrical housing 92 having an annular support flange 93 disposed about one end thereof. Extending downwardly from annular support flange 93, there is a triad of globe support projections 94A, 94B and 94C which, as will be described in detail hereinafter, serve to support globe 90 by way of open-ended spring clip 89. On the inside surface of cylindrical housing 92, a triad of symmetrically disposed engaging projections 95A, 95B and 95C extend outwardly in the open central passageway 96 of cylindrical housing 92. Engaging projections 95A, 95B and 95C are adapted to releasably engage a respective lamp socket support projection 79A, 79B, and 79C by performing a simple lift and turning operation, whereby projections 95A, 95B and 95C insert into slot 80 of respective projections 79A, 79B and 79C. Together, lamp socket support projections 79A, 79B and 79C and engaging projections 95A, 95B and 95C constitute a means for releasably securing lamp socket support 70 to globe support 71, while the lamp support 73 is positioned within the globe support housing 92. At the same time, this interface of lamp socket subassembly and globe subassembly 71 provides a plurality of air-flow channels 97 between globe support housing 92 and lamp socket support body 75, as shown in FIG. 15.

Globe 90 of the present invention comprises an open end 98 and a closed end 99 with side walls 100 extending therebetween to enclose an inner volume generally indicated by reference numeral 101. Disposed about the opened end 98 of the globe, a continuous flange 102 is provided. In this way, open ended spring clip 89 can surround globe 90 from below continuous flange 102 and engage globe support projections 94A, 94B and 94C, as shown in FIG. 14. As illustrated in FIG. 15, this structural arrangement permits globe 90 to be releasably retained at a predetermined distance from the bottom of support flange 93, and thereby provide a plurality of air flow passages 103 between globe support housing 92 and globe 90.

As illustrated in FIG. 15, when globe subassembly 71 and lamp socket subassembly 70 are completely assembled and interconnected together with shade 72 resting on support flange 93, halogen lamp 85 extends into volume 101 and is completely enclosed by globe 90. In this assembled configuration, air-flow passageways 103 are in communication with air-flow channels 97, and both air-flow passageways 103 and air-flow channels 97 are in communication with ambient atmosphere. Air flow patterns created by the air-flow passageways and channels of the luminaire assembly, serve to carry heat away from halogen lamp 85, up along air-flow channels 97, and into ambient atmosphere. By transferring such heat, the halogen lamp can operate at lower temperatures thereby ensuring longer operating life.

While the illustrated embodiment of the luminaire assembly has utilized cylindrical geometries for housings 75 and 92, and circular geometries for aperture 91 and support flange 93, it is understood that other geometries can be utilized in carrying out the principles of the present invention.

While the particular embodiments shown and described above have proven to be useful in many applications in the illumination art, further modifications of the present invention herein disclosed will occur to persons skilled in the art to which the present invention pertains, and all such modifications are deemed to be within the scope and spirit of the present invention defined by the appended claims.

What is claimed is:

1. A luminaire assembly which comprises:

a lamp socket subassembly, including a lamp socket mounted to a lamp-socket support means and adapted for suspension from a support structure;

a globe subassembly, including a globe having an open end and a globe support means having a central passageway permitting positioning of said lamp socket support means therein, said globe subassembly further including globe retaining means for releasably retaining said globe at a distance from said globe support means so as to provide one or more air-flow passageways between said globe support means and said globe; and securing means for releasably securing said lamp socket support means to said globe support means while said lamp socket support means is positioned within said globe support means and providing one or more air-flow channels between said globe support means and said lamp socket support means.

2. The luminaire assembly of claim 1, wherein said globe support means further includes a shade support flange for supporting a shade.

3. The luminaire assembly of claim 2, wherein said airflow passageways are in communication with said air-flow channels, and said air-flow passageways and said air-flow channels are in communication with ambient atmosphere.

4. The luminaire assembly of claim 3, wherein said globe support means comprises a cylindrical housing and said shade support flange is disposed about said cylindrical housing.

5. The luminaire assembly of claim 4, wherein said support structure comprises a support cable, and wherein said lamp socket support means comprises a cylindrical body portion having a centrally disposed aperture through which said support cable is permitted to pass and behind which said support cable is capable of being secured, said lamp socket support means further including a port permitting passage of electrical cord to said lamp socket.

6. The luminaire assembly of claim 5, wherein said securing means comprises a plurality of lamp socket support projections extending from said lamp socket support means, and a plurality of engaging projections extending from said globe support means within said central passageway thereof, each said engaging projection being adapted to releasably engage a respective said lamp socket support projection.

7. The luminaire assembly of claim 6, wherein said globe support means further comprises a plurality of globe support projections extending from below said shade support flange, and wherein said globe includes a continuous flange disposed about said open end of said globe.

8. The luminaire assembly of claim 7, wherein said globe retaining means comprises an open ended spring clip adapted to surround said globe from below said continuous flange and engage said globe support projections so as to releasably retain said globe at said distance from said globe support means and provide said one or more air-flow passageways between said globe support means and said globe.

9. The luminaire assembly of claim 8, wherein said lamp socket is adapted to receive and provide electrical power to a halogen lamp received by said lamp socket, wherein said halogen lamp extends into and is enclosed by said globe, said globe having a closed end opposite said open end.

10. The luminaire assembly of claim 9, wherein each said lamp socket support projection comprises at least a three sided projection enclosing a slot adapted for releasable receipt of one said engaging projection.

11. The luminaire assembly of claim 10, which further comprises a shade having a centrally disposed opening adapted to permit passage of said cylindrical body, therethrough said shade further having an inner portion adjacent said centrally disposed opening which is adapted to rest upon and be supported by said shade support flange.

12. A jack for use with different types of plug connectors, which comprises:

a socket having an opening and a bore extending from said opening along a longitudinal axis, said bore having a first cylindrical portion adjacent said opening and bearing threads adapted to be received by matching threads disposed on a first type plug connector having a stem portion which is screwable into said socket;

a stem retaining means disposed at a predetermined distance along said longitudinal axis of said bore, said stem retaining means including a plug retaining element operably associated with said bore and adapted for releasable snap-fit engagement with a selected portion of a circumferential groove formed in a stem portion of a second type plug connector when the stem portion of said second type plug connector is slidably inserted through the opening in said socket and along said bore; and first and second conductive jack elements disposed at a predetermined distance apart along said longitudinal axis and beyond said first cylindrical portion, said first and second jack conductive element each being positioned with respect to said longitudinal axis so as to be capable of engaging spaced apart first and second conductive plug elements disposed on said stem portions of said plug connectors when said first type plug connector is screwed into said socket or said second type connector is slidably inserted through the opening of said socket.

13. The jack of claim 12, wherein said bore further has a second portion disposed beyond said first cylindrical portion.

14. The jack of claim 12, wherein said socket comprises a cylindrical housing bearing external threads and a housing flange disposed adjacent said opening, said cylindrical housing further having at least one or more spring tabs projecting from said cylindrical housing and adapted to retain said cylindrical housing within an aperture formed in a supporting structure while a threaded lock nut is being threaded over said external threads of said cylindrical housing.

15. The jack of claim 14, wherein said cylindrical housing has at least one or more recesses formed in said cylindrical housing proximate said housing flange threads for installation of said respective spring tabs.

16. The jack of claim 14, in combination with a socket adaptor having a central bore approximately equal to a diameter of said stem portion of second type plug connector and being adapted for releasable insertion into at least a portion of said first cylindrical portion of said jack so that said stem portion of said second type plug connector can pass through said central bore and first and second conductive plug elements of said second type plug connector interconnect with said first and second conductive jack elements, respectively.

17. A jack for use with different types of plug connectors, which comprises:

a socket having an opening and a bore extending from said opening along a longitudinal axis, said bore having a first cylindrical portion adjacent said opening and bearing threads adapted to be received by matching threads disposed on a first type plug connector having a stem portion which is screwable into said socket;

a stem retaining means disposed at a predetermined distance along said longitudinal axis of said bore, so as to releasably retain a second type plug connector having a stem portion surface formulation which is pluggable into said socket;

first and second conductive jack elements disposed at a predetermined distance apart along said longitudinal axis and beyond said first cylindrical portion, said first and second jack conductive elements each being positioned with respect to said longitudinal axis so as to be capable of engaging spaced apart first and second conductive plug elements disposed on said stem portions of said plug connectors when said first type plug connector is screwed into said socket or said second type plug connector is plugged into said socket;

wherein said bore further has a second portion disposed beyond said first cylindrical portion and contains a module having a module bore into which said first and second conductive jack elements extend so that when said first or second type plug connector is inserted into said socket, the stem of said first or second type plug connector passes through at least a portion of said module bore and said first conductive plug element of said first or second type plug connector engages said first conductive jack element and said second conductive plug element of said first or second type plug connector engages said second conductive jack element.

18. The jack of claim 17, wherein said module further comprises first and second transverse slots passing through said module bore and which are adapted to receive said first and second conductive jack elements, respectively.

19. The jack of claim 18, wherein said first and second conductive jack elements further comprise a pair of resilient conductive arms which are adapted to snap into said first and second traverse slots, respectively.

20. The jack of claim 19, wherein each said resilient conductive arm comprises a substantially planar portion extending through said module bore and a retaining tab at the end of each conductive arm adapted to retain said conductive arms in said respective traverse slot.

21. The jack of claim 20, wherein first and second lead wires are connected to said first and second conductive jack elements, respectively, and said lead wires extend along said second portion of said bore and beyond said bore.

22. The jack of claim 21, wherein said module further comprises a third transverse slot passing through said module bore, and said plug stem retaining means comprises a spring element slidably disposed in said third transverse slot which extends partially into said module bore and is adapted to engage with said surface formation, said surface formation comprising a circumferential groove formed in the stem of said second type plug connector when said second type plug connector is plugged into said socket.

23. The jack of claim 22, wherein said second portion of said bore is cylindrical and is provided with threads, and a threaded retaining ring is threaded into said second portion so as to abut against and secure said module into said second portion and permit passage of said lead wires beyond said retaining ring.

24. The jack of claim 23, wherein said second portion has a larger diameter than said first cylindrical portion and is provided with at least one guide slot orthogonally disposed with respect to said longitudinal axis, and wherein said module is provided with at least one guide flange orthogonally disposed with respect to said module bore, said guide flange being adapted to be received within said guide slot and prevent said module from rotating when said matching threads on said first type plug connector are threaded over said threads on said first cylindrical portion of said bore.

25. A lighting system comprising:

A power jack including a socket having an opening and a bore extending from said opening along a longitudinal axis, said bore having a first cylindrical portion adjacent said opening and bearing threads adapted to be received by matching threads disposed on a first type plug connector having a stem portion which is screwable into said socket, a stem retaining means disposed at a predetermined distance along said longitudinal axis of said bore, so as to releasably retain a second type plug connector having a stem portion surface formulation which is pluggable into said socket, and a first and second conductive jack elements disposed at a predetermined distance apart along said longitudinal axis and beyond said first cylindrical portion, said first and second conductive elements each being positioned with respect to said longitudinal axis so as to be capable of engaging spaced apart conductive plug elements disposed on said stem portions of said plug connectors when said first type plug connector is screwed into said socket or said second type plug connector is plugged into said socket;

a luminaire assembly including a lamp socket subassembly, including a lamp socket mounted to a lamp-socket support means and adapted for suspension from a support structure, a globe subassembly, including a globe having an open end and a globe support means having a central passageway permitting positioning of said lamp socket support means therein, said globe subassembly further including globe retaining means for releasably retaining said globe at a distance from said globe support means so as to provide one or more air-flow passageways between said globe support means and said globe, and securing means for releasably securing said lamp socket support means to said globe support means while said lamp socket support means is positioned within said globe support means and providing one or more air-flow channels between said globe support means and said lamp socket support means; and a first type plug connector or a second type plug connector operably associated with a support structure which operably associates said power jack and said luminaire assembly.

26. The lighting system of claim 25, wherein said air-flow passageways are in communication with said air-flow channels, and said air-flow passageways and said air-flow channels are in communication with ambient atmosphere.

27. The lighting system of claim 26, wherein said globe support means further includes a shade support flange for supporting a shade.

* * * * *